US010135160B2

(12) United States Patent
Tadele et al.

(10) Patent No.: US 10,135,160 B2
(45) Date of Patent: Nov. 20, 2018

(54) CONNECTION ELEMENT FOR FASTENING A METAL PART TO A PRINTED CIRCUIT BOARD

(71) Applicant: BorgWarner Ludwigsburg GmbH, Ludwigsburg (DE)

(72) Inventors: Sisay Tadele, Friolzheim (DE); Michael Störzinger, Bretten (DE); Helmut Hoppe, Stuttgart (DE); Alexander Dauth, Maulbronn (DE)

(73) Assignee: BorgWarner Ludwigsburg GmbH, Lugwigsburg (DE)

( * ) Notice: Subject to any disclaimer, the term of this patent is extended or adjusted under 35 U.S.C. 154(b) by 0 days.

(21) Appl. No.: 15/786,867

(22) Filed: Oct. 18, 2017

(65) Prior Publication Data

US 2018/0115094 A1 Apr. 26, 2018

(30) Foreign Application Priority Data

Oct. 21, 2016 (DE) ..... 10 2016 120 087

(51) Int. Cl.

| | |
|---|---|
| ***H01R 13/73*** | (2006.01) |
| ***H01R 12/58*** | (2011.01) |
| ***H01R 4/34*** | (2006.01) |
| ***H01R 12/70*** | (2011.01) |
| ***H01R 43/20*** | (2006.01) |
| *H01R 13/6595* | (2011.01) |

(52) U.S. Cl.

CPC ..... *H01R 12/58* (2013.01); *H01R 4/34* (2013.01); *H01R 12/585* (2013.01); *H01R 12/7047* (2013.01); *H01R 43/205* (2013.01); *H01R 13/6595* (2013.01)

(58) Field of Classification Search

CPC ..... H01R 23/7057; H01R 13/504; H01R 23/7063; H01R 13/748; H01R 13/533

USPC ..... 439/571, 572, 566, 570, 83, 564

See application file for complete search history.

(56) References Cited

U.S. PATENT DOCUMENTS

| | | | | |
|---|---|---|---|---|
| 7,491,070 | B2 * | 2/2009 | Chen | H01R 12/7047 361/804 |
| 8,109,704 | B2 * | 2/2012 | Lewis | F01M 11/0408 411/111 |
| 9,273,662 | B2 | 3/2016 | Halbrock et al. | |

FOREIGN PATENT DOCUMENTS

| | | |
|---|---|---|
| DE | 10 2012 021 324 A1 | 4/2014 |
| DE | 10 2013 022 242 A1 | 7/2015 |
| DE | 10 2013 103 090 B4 | 7/2016 |
| EP | 1 755 195 A1 | 2/2007 |

* cited by examiner

*Primary Examiner* — Phuong Chi T Nguyen

(74) *Attorney, Agent, or Firm* — Bose McKinney & Evans LLP

(57) ABSTRACT

What is described is a connection element for fastening a metal part to a printed circuit board, wherein the connection element has a first portion, which is formed as a press-fit pin to be pressed into a bore of the printed circuit board, and a second portion, which is formed as a screw to be screwed into the metal part.

12 Claims, 1 Drawing Sheet

CONNECTION ELEMENT FOR FASTENING A METAL PART TO A PRINTED CIRCUIT BOARD

RELATED APPLICATIONS

This application claims priority to DE 10 2016 120 087.5, filed Oct. 21, 2016, the entire disclosure of which is hereby incorporated herein by reference in its entirety.

BACKGROUND

The present invention relates to techniques for connecting printed circuit boards to metal parts, for example heat sinks, busbars, and housings. The connection between a metal part of this type and a printed circuit board, besides a mechanical connection, must also provide electrical contacting, for example so as to avoid problems with regard to the electromagnetic compatibility or electrostatic discharges by means of a ground connection.

In particular in the case of metal parts made of aluminium, reliable contacting is problematic, since aluminium oxide layers can form, which are very hard and electrically insulating. Reliable contacting therefore in many cases requires high contact forces, which can be achieved with complex spring contact-making means. Another possibility lies in forming press-fit pins in or on the metal part, which pins are pressed into metallised drilled holes of a printed circuit board. Press-fit pins of this type generally have a thickness in the range of from 0.6 mm to 1.1 mm. In the case of metal parts that have a corresponding thickness, such press-fit pins generally can be formed well. In the case of thicker or more solid metal parts, however, this is often not possible with reasonable effort, and therefore costly solder connections are often used.

SUMMARY

This disclosure shows how metal parts, in particular housings, busbars, and heat sinks, can be reliably and economically fastened to a printed circuit board.

A connection element according to this disclosure has a first portion, which is formed as a press-fit pin to be pressed into a bore of the printed circuit board, and a second portion, which is formed as a screw to be screwed into a metal part to be connected to a printed circuit board.

Since the connection element has a second portion formed as a screw, it can be mechanically and electrically reliably connected to a metal part, in particular a more solid metal part, such as a housing, a heat sink or a larger busbar, from which a press-fit pin cannot be formed or can only be formed with great effort. The first portion, which is formed as a press-fit pin to be pressed into a bore of a printed circuit board, can be formed here as a solid or as an open pin. Suitable forms of press-fit pins are disclosed for example in U.S. Publication No. 2014/0291314 A1 the content of which is incorporated herein by reference. Specifically, U.S. Publication No. 2014/0291314 teaches that press-fit connections are known as alternatives to soldered connections. Press-pins for this purpose are made of bronze, brass or copper irons. It also teaches that copper-nickel alloys of this type have a low temperature-dependence of the resistance in combination with very good mechanical properties, in particular a resilient elasticity, which enables good press-fit connections.

An advantageous refinement of this disclosure provides that the screw of the second portion of the connection element is a self-tapping or self-cutting screw. In this way, a particularly good electrical contact can be produced between the connection element and the metal part into which the screw is screwed, since a self-tapping or self-cutting screw breaks up any oxide layers present on the surface of the metal part. A self-tapping or self-cutting screw is particularly suitable for metal parts made of aluminium, since aluminium is relatively soft.

A connection element according to this disclosure can be formed in one piece, i.e., can comprise a body made of a material which forms both the first portion and the second portion, wherein the first portion and/or the second portion can be coated so as to optimise the corresponding portion for its function. Another possibility lies in producing the first portion and the second portion from different materials. By way of example, the first portion can be produced from brass and the second portion can be produced from steel. Brass has good mechanical properties which are advantageous for press-fit connections, in particular a high resilience. Steel has a relatively high hardness, which is favorable for a screw connection, in particular for a self-tapping or self-cutting screw. The first and the second portion of a connection element according to this disclosure can be connected for example by welding.

A further advantageous refinement of this disclosure provides that the second portion of the connection element formed as a screw has a screw head which has flats against which a tool, for example a spanner, can be placed so as to transfer to the connection element a torque for establishing or releasing a screw connection. The screw head can be for example a polygon, in particular a hexagon.

A further advantageous refinement of this disclosure provides that the first portion formed as a press-fit pin has a widened middle part. The middle part can have for example a convexly curved surface. Due to the widening, the width and/or the thickness of the middle part can be increased compared to the adjacent regions of the first portion.

This disclosure also relates to the use of a connection element according to this disclosure for fastening a metal part to a printed circuit board. By way of example, the metal part can be a metal body, for example a housing, a heat sink, or a busbar. This disclosure additionally also relates to a metal part into which a connection element according to this disclosure is screwed via its second portion.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 4:
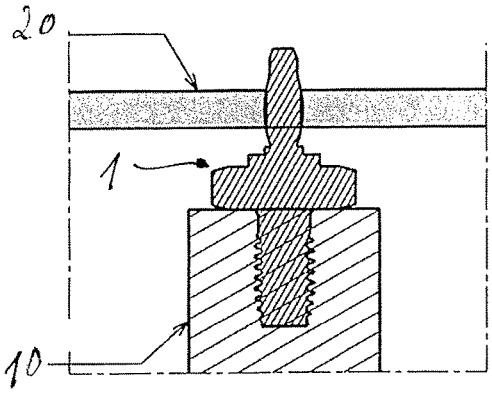
FIG. 4 shows a schematic sectional view of a printed circuit board with the illustrated connection element and a metal body.

The connection element (or connector) illustrated in the drawings serves to fasten a metal part 10 (illustrated schematically in FIG. 4) to a printed circuit board 20.

The metal part 10 by way of example can be a heat sink, a housing, or a busbar, and can be made of any metal, in particular aluminium. The connection element 1 has a first portion 2, which is formed as a press-fit pin to be pressed into a bore of a printed circuit board 20, and a second portion 3, which is formed as a screw to be screwed into the metal part 10.

Figure 1:
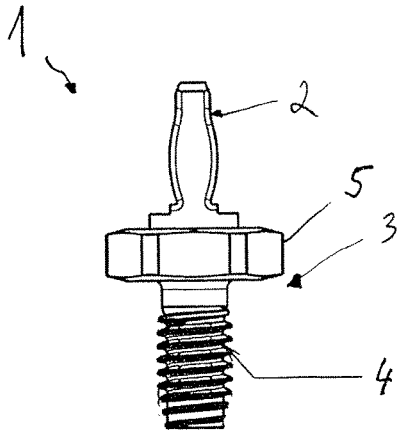
FIG. 1 shows a connection element for fastening a metal part to a printed circuit board.
Figure 2:
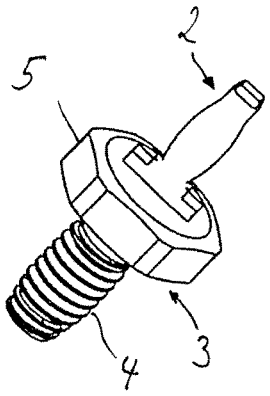
FIG. 2 shows an isometric view of FIG. 1.
Figure 3:
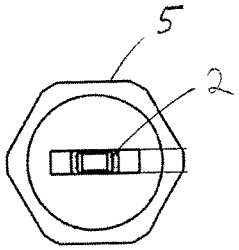
FIG. 3 shows the connection element of FIG. 1 in plain view.

The first portion 2 formed as a press-fit pin can be solid or can have an opening so as to increase its flexibility when pressed into a bore of the printed circuit board 20. The first portion 2 formed as a press-fit pin can have a widened middle part in order to improve the press-fit connection to the printed circuit board 20. As shown in FIG. 1, the width of the first portion 2 is increased in the widened middle part. The plan view of FIG. 3 shows that, in the illustrated embodiment, the thickness of the middle part is constant. Alternatively or additionally, however, the thickness can also be increased in the middle part.

The second portion 3 of the connection element 1 formed as a screw has a threaded shank 4, which can be formed as a self-tapping or self-cutting screw, and a screw head 5, via which a torque for establishing or releasing a screw connection to the metal body 10 can be introduced into the connection element 1. The screw head 5 for this purpose has two or more flats, against which a tool, for example a spanner, can be placed. The screw head 5 by way of example can be formed as a polygon, in particular as a hexagon, as in the illustrated exemplary embodiment.

The described connection element 1 can be made from different materials. By way of example, the first portion 2 can be produced from brass, for example CuNi3Si1Mg. Brass has excellent material properties for press-fit connections. The second portion by way of example can be made of steel, for example cold heading wire or 23MnB4 steel. The first portion 2 and the second portion 3 can be welded to one another, for example.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SIGNS

1 connection element
2 first portion
3 second portion
4 threaded shank
5 screw head
10 metal part
20 printed circuit board

What is claimed is:

1. A connection element for fastening a metal part to a printed circuit board, comprising:

a first portion formed as a resilient press-fit pin configured to be pressed into a bore of the printed circuit board; and a second portion formed as a screw configured to be screwed into the metal part.

2. The connection element according to claim 1, wherein the second portion comprises a self-tapping or self-cutting screw.

3. The connection element according to claim 1, wherein the second portion has a screw head configured for transferring a torque for establishing or releasing a screw connection to the connection element.

4. The connection element according to claim 1, wherein the first portion has a widened middle part.

5. The connection element according to claim 1, wherein the first portion and the second portion have different material compositions.

6. The connection element according to claim 5, wherein the first portion is made of brass.

7. The connection element according to claim 5, wherein the second portion is made of steel.

8. The connection element according to claim 5, wherein the first portion and the second portion are welded to one another.

9. A system for fastening a metal part to a printed circuit board, comprising:

a printed circuit board;

a metal part; and a connection element having a first portion formed as a resilient press-fit pin configured to be pressed into a bore of the printed circuit board and a second portion formed as a screw configured to be screwed into the metal part.

10. System according to claim 9, wherein the metal part is made of aluminium.

11. A method of fastening a printed circuit board to a metal part, the method comprising:

providing a metal part and a printed circuit board;

providing a connection element having a resilient press-fit portion and a thread portion;

pressing the press-fit portion into a bore of the printed circuit board; and screwing the thread portion into the metal part.

12. The method of claim 11, wherein the step of screwing the thread portion into the metal part comprises self-tapping or self-cutting of the thread into the metal part.

* * * * *